US009579920B2

(12) United States Patent
Schneider

(10) Patent No.: US 9,579,920 B2
(45) Date of Patent: Feb. 28, 2017

(54) DIE UNIT AND SYSTEM FOR CONSTRUCTING DIE UNITS

(75) Inventor: Albrecht Schneider, Oberursel (DE)

(73) Assignee: Julia Vanderpool, Oberursel (DE)

( * ) Notice: Subject to any disclaimer, the term of this patent is extended or adjusted under 35 U.S.C. 154(b) by 121 days.

(21) Appl. No.: 14/390,295

(22) PCT Filed: Sep. 5, 2012

(86) PCT No.: PCT/EP2012/003723

§ 371 (c)(1),
(2), (4) Date: Oct. 2, 2014

(87) PCT Pub. No.: WO2013/149630

PCT Pub. Date: Oct. 10, 2013

(65) Prior Publication Data

US 2015/0047521 A1 Feb. 19, 2015

(30) Foreign Application Priority Data

Apr. 3, 2012 (DE) ..... 10 2012 006 665
Jul. 25, 2012 (DE) ..... 10 2012 014 698

(51) Int. Cl.
*B41N 6/00* (2006.01)
*B21D 28/34* (2006.01)
*B41K 1/36* (2006.01)

(52) U.S. Cl.
CPC ..... *B41N 6/00* (2013.01); *B21D 28/34* (2013.01); *B41K 1/36* (2013.01)

(58) Field of Classification Search
CPC ..... B41N 6/00; B41K 1/36; B21D 28/34
USPC ..... 83/549, 698.91, 405, 531, 532
See application file for complete search history.

(56) References Cited

U.S. PATENT DOCUMENTS 17,455 A * 6/1857 Shaw ..... B26D 3/12 83/12
1,910,296 A * 5/1933 King ..... B21D 28/34 279/77
2,420,146 A * 5/1947 Mueller ..... B21D 28/34 279/155
2,997,907 A * 8/1961 Constantino ..... B21D 28/04 83/140
3,103,845 A * 9/1963 Porter ..... B21D 28/34 29/426.5

(Continued)

FOREIGN PATENT DOCUMENTS

DE 102008062471 A1 6/2010
EP 0000762 A1 2/1979

(Continued)

OTHER PUBLICATIONS

WIPO International Bureau, International Preliminary Report on Patentability (English Translation) for PCT/EP2012/003723, Oct. 16, 2014.

*Primary Examiner* — Sean Michalski
(74) *Attorney, Agent, or Firm* — Christopher C. Dremann, P.C.; Christopher C. Dremann

(57) ABSTRACT

A die unit fastened to an upper part of a stamping tool has a pressure plate, a stamping die, and a die-holding plate. In order to reduce the production cost, the pressure plate is arranged between the stamping die and the die-holding plate, wherein the pressure plate acts on a shoulder of the stamping die during a stamping stroke.

17 Claims, 13 Drawing Sheets

(56) References Cited

U.S. PATENT DOCUMENTS 3,563,124 A * 2/1971 Gargrave ..... B21D 28/34 83/691
3,677,118 A * 7/1972 Abbott ..... B29C 37/02 83/211
3,935,771 A * 2/1976 Cady, Jr. ..... B21D 28/34 83/140
4,031,787 A * 6/1977 Cady ..... B21D 28/34 83/140
4,064,917 A * 12/1977 Diaz ..... H01L 21/67138 140/105
4,092,888 A * 6/1978 Wilson ..... B21D 28/34 83/140
4,166,403 A 9/1979 DiDonato, Jr. et al.
4,265,104 A * 5/1981 Todeschini ..... B21D 28/06 72/330
4,375,774 A * 3/1983 Wilson ..... B21D 28/34 83/140
4,377,100 A * 3/1983 Wallis ..... B21D 28/34 279/77
4,555,966 A * 12/1985 Klingel ..... B21D 28/34 234/113
4,604,931 A * 8/1986 Bastian ..... B26F 1/14 279/76
4,726,270 A * 2/1988 Lucas ..... B21D 28/34 279/30
5,038,599 A * 8/1991 Wellman ..... B21D 28/34 279/30
5,181,438 A * 1/1993 Wellman ..... B21D 28/34 279/30
5,419,225 A * 5/1995 Fujita ..... B21D 28/20 83/140
5,613,416 A 3/1997 Fujita
5,839,183 A * 11/1998 Powlett ..... B21D 28/34 29/464
6,276,247 B1 * 8/2001 Helda ..... B21D 28/34 83/684
6,334,381 B1 * 1/2002 Chatham ..... B21D 28/12 83/588
6,679,147 B1 * 1/2004 Chaulklin ..... B21D 28/34 83/684
7,707,919 B1 * 5/2010 Moellering ..... B21D 45/006 83/111
7,823,435 B2 * 11/2010 Bandou ..... B30B 15/026 72/448
8,820,200 B1 * 9/2014 Quinn ..... B30B 15/028 83/102
2002/0007714 A1 * 1/2002 Ohtsuka ..... B21D 19/08 83/698.31
2002/0189420 A1 * 12/2002 Rosene ..... B21D 28/34 83/699.41
2006/0048623 A1 * 3/2006 Schneider ..... B21D 28/34 83/698.91
2008/0066601 A1 * 3/2008 Kitamura ..... B21D 28/34 83/698.91
2009/0178522 A1 * 7/2009 Saimen ..... H05K 3/0052 83/27
2010/0095824 A1 * 4/2010 Laib ..... B21D 28/14 83/549
2015/0047521 A1 * 2/2015 Schneider ..... B21D 28/34 101/382.1

FOREIGN PATENT DOCUMENTS

EP 0628364 A1 12/1994
GB 2038690 A 7/1980

* cited by examiner

PRIOR ART

PRIOR ART 172
133
132
133
282
314
280
284
164
166
168
174
172
137
132
314
282
280
284
164
166
168
174
172
370
315
314
362

DIE UNIT AND SYSTEM FOR CONSTRUCTING DIE UNITS

CROSS REFERENCE TO RELATED APPLICATIONS

This application claims the benefit of priority to International Application No. PCT/EP2012/003723 filed on Sep. 5, 2012, and to German Application No. DE 10 2012 014 698.1 filed on Jul. 25, 2012, and to German Application No. DE 10 2012 006 665.1 filed on Apr. 3, 2012, the entire disclosures of which are incorporated herein by reference.

FIELD OF THE INVENTION

The present invention is concerned with a die unit for fastening to an upper part of a stamping tool, with a pressure plate, with a stamping die and with a die-holding plate.

BACKGROUND OF THE INVENTION

Die units of this type have hitherto been set up, without exception, by a fully profiled forming die being produced over its entire length with its stamping cross section being cut out from a solid hardened block over its entire length by wire erosion. In a conventional method for fastening the die in the die-holding plate, an embossing die is produced in the form of the die, with the peripheral chamfer which is desired. The upper end of the forming die is subsequently heated and the chamfer is upset on the die by means of a press in the embossing mould. The chamfer of the upset head also serves for withdrawing the stamping die, the heating described bringing about the additional effect that the hardness of the die is reduced in the head region due to the annealing effect.

After the forming die has been pushed into the die receptacle, the latter is ground over on the head side and then screwed to a pressure plate made from hardened steel. During a stamping stroke, the stamping forces then act via the pressure plate upon the die head which forms the rear end of the forming die.

This solution makes it necessary for a dedicated die unit to have to be kept ready for every stamping-die cross section required, wherein the die-holding plate has to be manufactured individually for each individual forming die.

A die unit produced in this way is fastened to an upper part of a stamping tool, for example by means of two screws, this mostly being a column-guided standard frame. A plurality of individual die units may be installed in a tool if a plurality of desired perforations are to be made.

SUMMARY AND OBJECTS OF THE INVENTION

An object of the present invention is to provide a stamping die unit, of which the outlay in production terms is reduced.

This object is achieved, according to the invention, in that the pressure plate is arranged between the stamping die and the die-holding plate, wherein, during a stamping stroke, said pressure plate acts upon a shoulder of the stamping die.

The solution according to the invention affords the advantage that the length of the continuously profiled forming die can be shortened by about thirty percent (30%), a considerable shortening of work time also occurring. In the solution according to the invention, the individual parts can also be screwed to one another releasably, so that both the upsetting and the production of an exact upset die for producing the stamping die and the grounding-over of the upset forming die after insertion into the die-holding plate are dispensed with. A further advantage is that stamping dies with different forming cross sections can be used with standardized pressure plates and die-holding plates, since these no longer have to be cut out correspondingly to the profiling of the die. At the same time, it is even possible for the cross section of the die to be larger in some regions than the die reception plate, and therefore multiple reception plates can be avoided. If, for example, the dimensions of a fully profiled forming die have to be changed, there is no need to change the die reception plate, too.

In a preferred embodiment of the invention, there is provision whereby, on the shoulder of the stamping die, a holding shoe is provided, which projects through a slot in the pressure plate and which is fastened in the die-holding plate. The holding shoe is preferably manufactured with specific dimensions, so that, as already indicated above, stamping dies with different forming cross sections can easily be used together with standardized die-holding plates and pressure plates, the orifices of which are no longer adapted to the individual shape of the stamping die, but instead to the standardized holding shoe. The holding shoe is preferably arranged at right angles to the shoulder.

In a further preferred embodiment of the invention, the die-holding plate has releasable fastening means which cooperate with matching fastening means on the holding shoe. It is thereby possible to change the die in the tool, without the die unit having to be released from the overall stamping tool. In the simplest case, at least one bore, into which a bolt engages, can be provided in the holding shoe. In this embodiment, after the release of the bolt, it is readily possible to draw the stamping die downwards out of the receptacle for the holding shoe in the die-holding plate and the pressure plate. The standardized holding shoe also makes it possible to stock die blanks with a corresponding holding shoe and then, as required, to produce the desired shape of the stamping die in the shortest possible time simply by wire erosion, without the system for fastening the stamping die in the die unit being changed in any way as a result. It is necessary merely to ensure that the forming cross section to some extent uniformly surrounds the holding shoe, the projection of the holding shoe preferably always meeting the die cross section and not protruding laterally.

The bolts that fasten the holding shoe may have, for example, a threaded region which is screwed into a threaded bore in the die-holding plate. The stamping dies can thereby be released in a simple way.

The bolt preferably possesses a conical head which cooperates with a conical bore in the holding shoe. When the bolt is being screwed in, it can then draw the stamping die with its shoulder up against the pressure plate, thus ensuring play-free contact between the pressure plate and the shoulder of the stamping die.

Suitable fastening elements are expediently provided for fastening the die unit to an upper part of a stamping tool.

A preferred embodiment of the die unit provides for the die unit to have a holding-down device which is guided resiliently on the pressure plate by means of guide bolts. Such a holding-down device can be implemented especially simply in the arrangement according to the invention of the elements of a die unit, since the hardened pressure plate can readily receive, free of wear, ground guide bores for the guide bolts. The guide bolts may consist of bronze or of coated hardened steel, to name only two examples. The spring elements are compressed as a result of the stamping stroke, the four guide columns then move upwards in the die-holding plate in clear bores provided for this purpose. The travel is limited by the height of the die-holding plate, minus the head height of the guide bolts.

In the slot of the die-holding plate for receiving the holding shoe of the stamping die, there is preferably provided a transverse web. Said transverse web, which is situated in the region of a fitting jaw of the stamping die, increases the stability of the die-holding plate in the region of the slot, such that it is not possible for changes in dimension to occur as a result of the high forces acting as a result of the tightening of the fastening bolts. In a further preferred embodiment of the invention, it is provided that the slot in the die-holding plate and the slot in the pressure plate are arranged eccentrically offset in an aligned manner. Owing to the asymmetrical arrangement of the receiving nests for the die shoe, it is possible for very narrow stamping dies to be positioned very close together, which may be an advantage for certain applications. Accordingly, the die units are then mounted with the sides of the relatively small spacing to the slots against one another in the tool.

The stamping die preferably possesses an extension for a pull-out device for pulling out in the stamping direction.

After the die-holding plate has been mounted, the dies of the present invention are finally installed after the die-holding plate is screwed and pinned, since, depending on design, the shoulders of the die conceal the screw holes and pin holes after mounting has taken place.

This is the case especially when the die has a wide shoulder which is supported on the pressure plate in order to absorb the stamping pressure, and therefore, in such a case, demounting is possible only after the removal of a stripping plate, in so far as one of these is present. The stamping die accordingly also has to be demounted in a first step if it is blunt or if the entire die unit is to be removed.

It has been shown that the stamping dies cannot always be readily removed after the release of the holding screws, since they may be jammed in the close fits. In this regard, the extension provided affords a possibility of applying a pull-out tool, in order to exert striking pulses in a directed manner upon the stamping die so that the latter comes loose from the die unit.

In one embodiment, the extension may have at least one blind bore or through-bore lying transversely to the stamping direction, while in the case of stamping dies with larger stamping surfaces it is also possible, in a further preferred embodiment, to provide in the stamping surface a threaded bore which is oriented parallel to the stamping direction. The above-described bores are preferably situated axially in alignment with a fixing means of the holding shoe, said fixing means generally being arranged centrally.

By means of the extensions, it is possible to apply a pull-out device for dismounting the stamping die, said pull-out device having a sliding hammer which, by way of a correspondingly designed adapter element, can be connected in positive locking fashion to the extension on the stamping die. In the case of a threaded bore being provided in the stamping surface, said adapter element may be composed very simply of an external thread, possibly directly on the guide bar of the sliding hammer, whereas, in the case of a transverse bore being provided, a U-shaped adapter may be provided which, by means of a transverse bolt, produces the positive locking connection to the stamping die for the purpose of introducing the striking pulses.

The present invention also provides a system for the set-up of die units according to one of the preceding embodiments. As already mentioned, the solution according to the invention enables standardized die-holding plates and pressure plates to be combined with stamping dies having different cross-sectional forms. Thus, for example, die-holding plates and pressure plates can be kept ready in pairs in a few standard sizes and can then be combined freely with the stamping dies by virtue of the standardized holding shoes. The possibility of keeping blanks with finished holding shoes in stock has already been described. The ultimate shaping of the stamping dies can then take place quickly and in a short time.

A further advantage of the solution according to the invention is, in general, that it is possible to use die-holding plates and pressure plates, the cross section of which does not have to be appreciably larger than the cross section of the stamping die. As a result, a considerably higher packing density of the die units can be achieved when these are mounted in the stamping tool. In the individual case, this may signify considerable cost benefits during stamping operations.

To increase the combination possibilities while obtaining an ideal arrangement of the stamping dies relative to one another, embodiments of a die unit may also be advantageous in which a single die-holding plate and/or a single pressure plate are/is provided for receiving a multiplicity of stamping dies. Correspondingly, a die-holding plate and/or pressure plate of said type has a multiplicity of slots for receiving the respective holding shoe of a stamping die. The slots may be arranged parallel or at any desired angle relative to one another, such that several stamping dies can be arranged in a very space-saving manner in the tool.

BRIEF DESCRIPTION OF THE DRAWING FIGURES

Exemplary embodiments of the invention are discussed in more detail below with reference to the accompanying drawings.

DETAILED DESCRIPTION OF EMBODIMENT OF THE INVENTION

Figure 1:
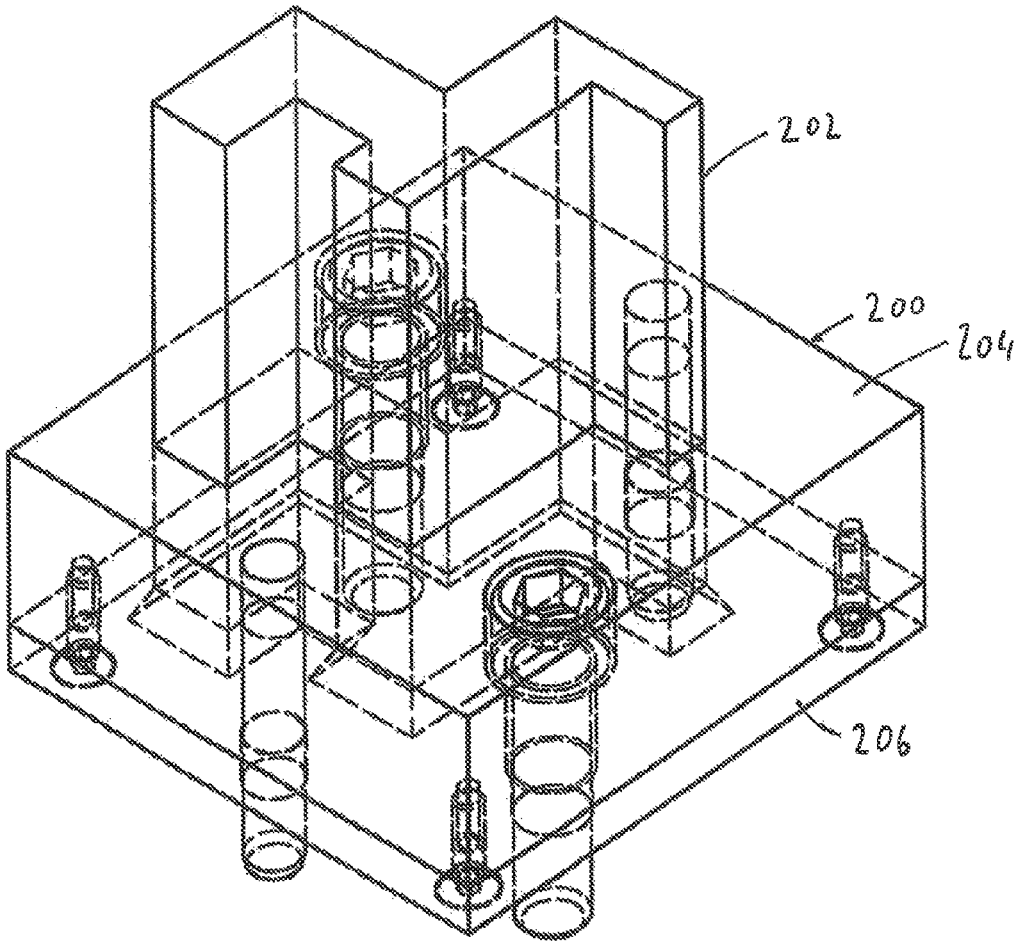
FIG. 1 shows a die unit according to the prior art in an oblique view.
Figure 2:
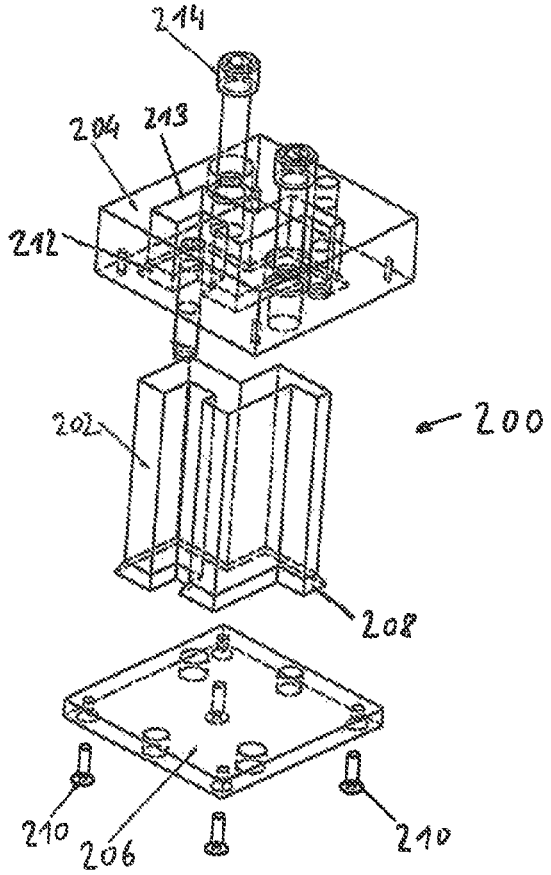
FIG. 2 shows an exploded diagram of the stamping die of the prior art die unit shown in FIG. 1.

FIG. 1 and FIG. 2 show a die unit 200 according to the prior art. This die unit 200 consists essentially of a forming die or stamping die 202, of a die-reception or die-holding plate 204, and of a pressure plate 206, the die-holding plate 204 being arranged between the pressure plate 206 and the stamping die 202. The stamping forces are transmitted by the pressure plate 206 to an upset head 208 (see FIG. 2) of the stamping die 202, the pressure plate 206 being screwed to the die-holding plate 204 by means of countersunk head screws 210. The stamping die 202 is also secured by means of its upset head 208 against falling out of the die-holding plate 204, which has a chamfer 212 for this purpose. After the upsetting of the upset head 208 of the stamping die 202, the latter is inserted into the die-holding plate 204, the die-holding plate 204 having a cut-out cross section 213 corresponding to the forming cross section of the stamping die 202. After the insertion of the stamping die 202, the rear side is ground over, smooth, in the head region of the stamping die 202, so that the pressure plate 206 can then be mounted, free of play. Fastening screws 214 serve for fastening the die unit 200 to the topside of a stamping tool (not shown).

This solution according to the prior art means that the stamping die 202 always has also to cover the entire height of the die-holding plate 204 and has to be made correspondingly longer. The type of mounting in the die unit 200 also means that the stamping die 202 can be dismantled, for example in order to regrind or exchange the stamping die, only after the die unit has been removed from the stamping tool. Moreover, a suitable die-holding plate 204, which has to be manufactured at corresponding outlay, has to be kept ready for each stamping die 202. On account of the grinding-over operation, each stamping die 202 is paired individually with a single die-holding plate 204.

Figure 3:
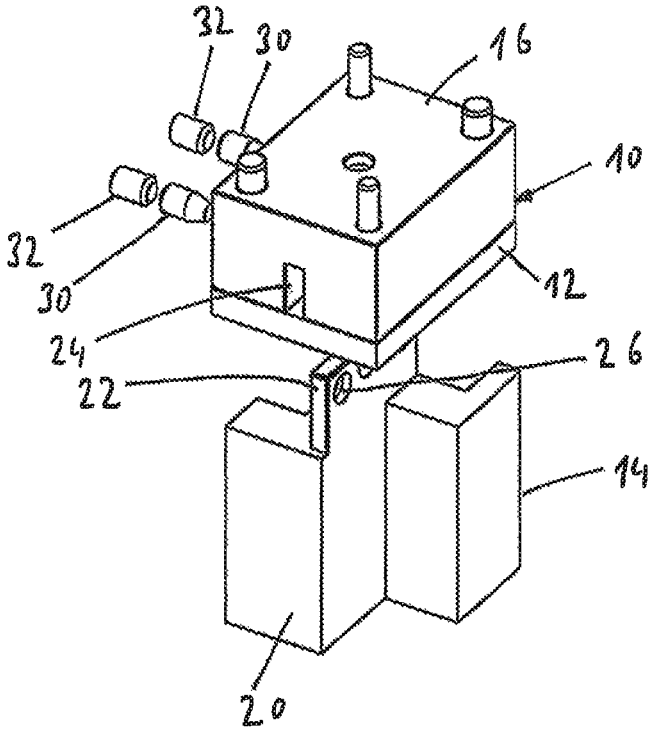
FIG. 3 shows an exploded diagram of a die unit according to the present invention in an oblique view.

FIG. 3 shows a die unit 10 according to the present invention in which a pressure plate 12 is arranged between a forming die or stamping die 14 and a die-reception or die-holding plate 16. The forming forces are in this case transmitted from the die-holding plate 16 via the pressure plate 12 to the stamping die 14, contact between the pressure plate 12 and the stamping die 14 taking place in the region of a shoulder 18 which does not mark the rear end of the stamping die 14. The shoulder 18 forms the head side of a forming cross section 20, the region of the shoulder 18 having adjoining it, as the rear end of the stamping die 14, a holding shoe 22 which possesses a specific height in relation to the shoulder 18 and a specific cross section. The projection of the holding shoe 22 should in this case meet the shoulder 18 completely, since the forming cross section 20 is otherwise very difficult to produce and strength problems may possibly also occur in the transitional region between the holding shoe 22 and the shoulder 18. The shoulder 18 and the holding shoe 22 are at right angles to one another.

Figure 4:
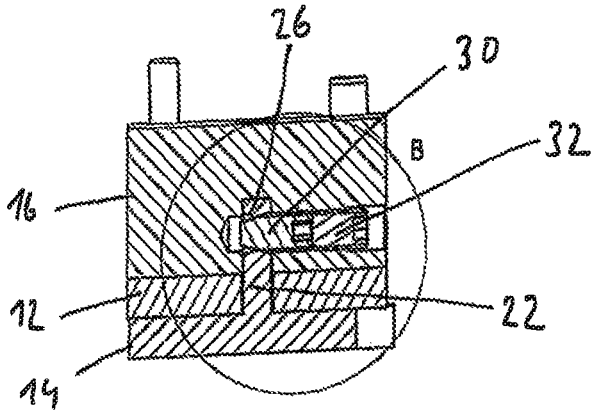
FIG. 4 shows a cross section of the die unit shown in FIG. 3.
Figure 5:
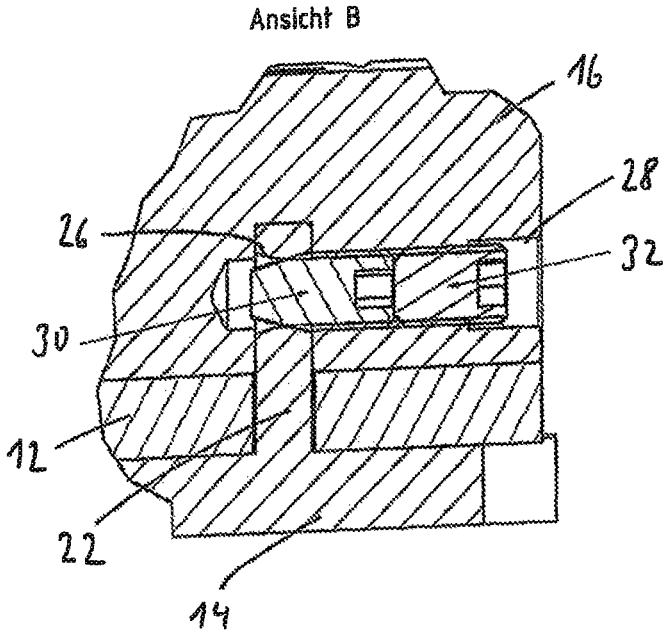
FIG. 5 shows a detail B taken from FIG. 4.
Figure 6:
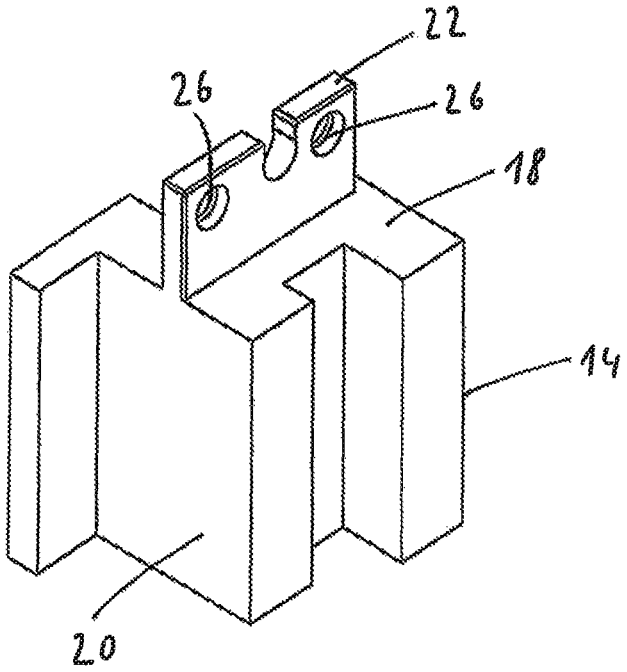
FIG. 6 shows an oblique view of the stamping die of the die unit shown in FIG. 3.
Figure 7:
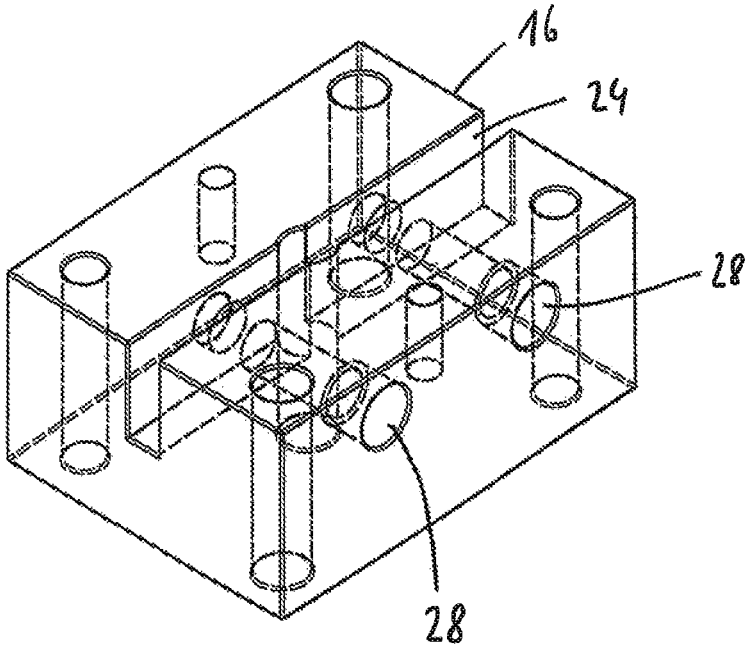
FIG. 7 shows an oblique view of the die holding plate of the die unit shown in FIG. 3.

The holding shoe 22 engages into a slot 24 (see FIG. 7) on the underside of the die-holding plate 16. In the inserted state, bores 26 in the holding shoe 22 are aligned with bores 28 in the die-holding plate 16 which are provided with an internal thread. This makes it possible to screw into the bores 28 threaded bolts which fix the stamping die 14 to the die-holding plate 16. The intermediate pressure plate 12 is screwed to the die-holding plate 16. The bolts 30 also make it possible to transmit tensile forces, such as occur during a return movement after a stamping stroke. These forces may be of an order of magnitude of 10 to 15% of the actual stamping forces, and therefore care must be taken to ensure sufficient strengths in the region of the screw connection. The screw connection itself is illustrated in more detail in FIG. 4 and FIG. 5. The holding shoe 22 is illustrated in cross section, and it can be seen that the bores 26 in the holding shoe 22 taper from the marginal regions in each case conically towards the center. The bore 26 cooperates correspondingly with a threaded bolt 30, the head of which is of frustoconical form. The holding shoe 22 and consequently the stamping die 14 are thereby positioned exactly when the bolt 30 is being screwed in, in that the said stamping die 14 is drawn with its shoulder, free of play, up against the pressure plate 12. A second threaded bolt 32 serves for securing the first threaded bolt 30 having the frustoconical head. Alternatively, a bolt with a head, for example a hexagon head, projecting laterally beyond the die-holding plate 16 may also be used. This may be advantageous when a plurality of holding plates 16 lie closely next to one another, since the heads can then be reached easily by means of a multi-cornered spanner, without the holding plates 16 having to be removed from the tool in order to change the stamping die.

Figure 8:
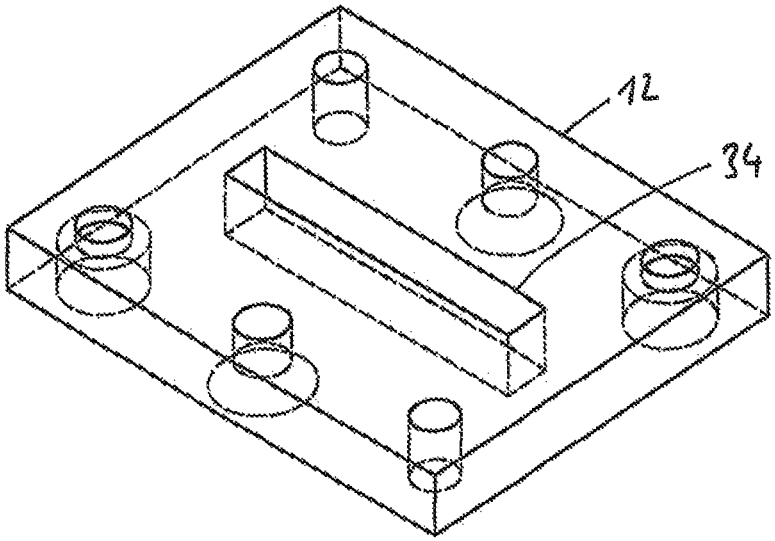
FIG. 8 shows an oblique view of the pressure plate of the die unit shown in FIG. 3.

The solution shown makes it possible to use a multiplicity of stamping dies 14 having very different forming cross sections in combination with one and the same die-holding plate 16 and pressure plate 12. The die-holding plate 16 must merely have, according to the above description, a slot 24 for receiving the holding shoe 22 and fastening means which cooperate with the fastening means of the stamping die 14 which are designed in the example as simple bores 26. The pressure plate 12 itself merely has to be provided with a simple slot 34 which is adapted to the cross-sectional form of the holding shoe 22. However, the guiding and positioning of the stamping die 14 is assumed by the die-holding plate 16, and therefore the slot 34 (see FIG. 8) in the pressure plate 12 does not have to satisfy too stringent requirements with regard to accuracy, thus making it possible to harden the pressure plate 12 even after the slot 34 has been produced, thereby lowering the costs.

The die unit 10 shown makes it possible, for example, to keep ready blanks of stamping dies 14 which already have on their topside the ready-formed holding shoe 22, but in the shank region possess a round or square or rectangular cross section which makes it possible to cut out a multiplicity of shapes. The said die unit 10 can then be produced in a simple way by the wire-erosion method, this being readily possible because of the absence of any undercut. A further major advantage of the solution shown is that the stamping die 14 can be removed even without the extraction of the die unit 10 from the stamping tool, by the two fastening bolts 30, 32 being released. It is no longer necessary to keep ready a die-holding plate 16 made specifically at high outlay for each stamping die 14, but instead it is possible to implement virtually all forming cross sections of the stamping die 14 which are required in a size range by means of a small number of die-holding plates 16 which, for example, cover various sizes. In addition to the production costs, the stock keeping costs are thereby also reduced.

Figure 9:
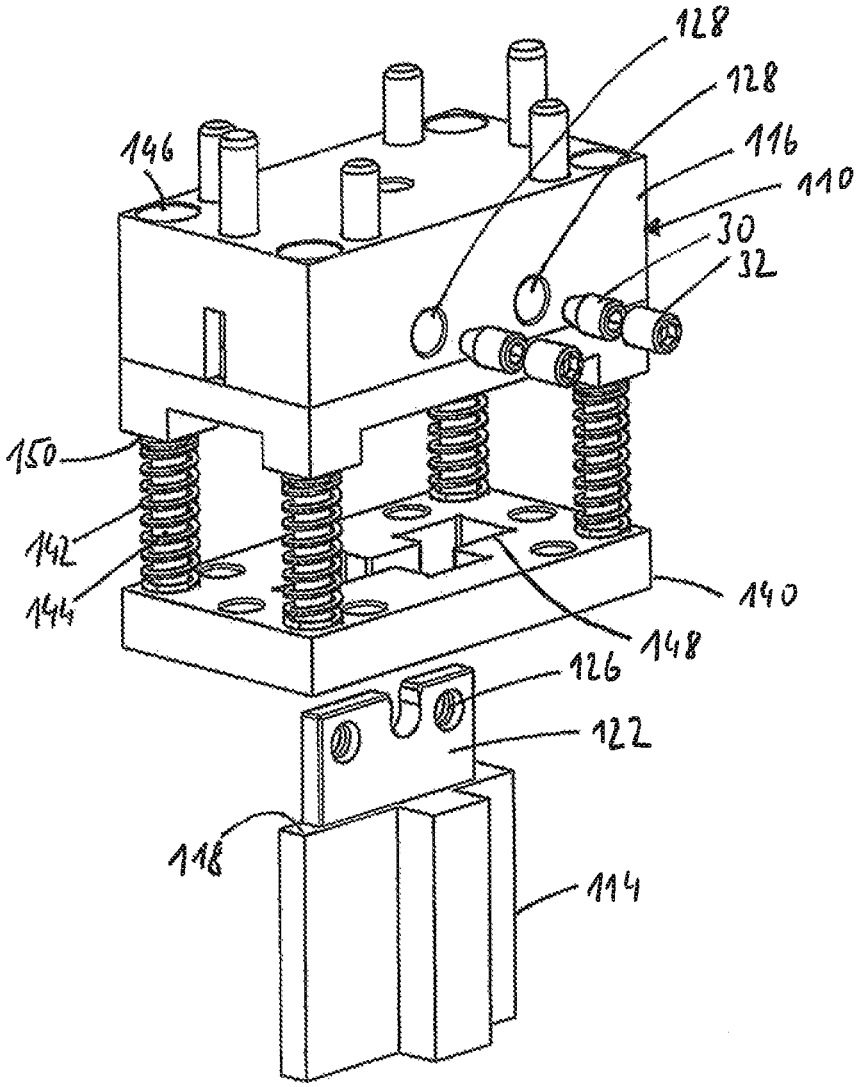
FIG. 9 shows a further embodiment of a die unit in an oblique view with an additional holding-down device.

FIG. 9 shows a preferred embodiment of a die unit 110 according to the present invention which again has a die-holding plate 116, a pressure plate 112 and a stamping die 114. Also shown again are the fastening bolts 30, 32 which are screwed into threaded bores 128 in the die-holding plate 116 in order to cooperate with bores 126 on a holding shoe 122 of the stamping die 114 and fix the same to the die unit 110. In addition to the embodiment described above, the die unit 110 shown in FIG. 9 possesses a holding-down device 140 which is guided movably on the pressure plate 112 via guide bolts 144 and intermediate helical compression springs 142. This is made possible by the pressure plate 112 arranged "below", which has in the region of its four corners in each case guide bores for the guide bolts 144. The guide bolts 144 themselves, when compressed, move in clear bores 146 in the die-holding plate 116. The holding-down device 140 serves for holding down the metal sheet during stamping and, after the actual stamping operation, as a stripper of the die unit 110 during the retraction movement. Since the forming cross section of the stamping die 114 marks the largest cross-sectional region and the holding-down device 140 has a cut-out 148 corresponding to the stamping-die 114 cross section, the stamping die 114 can easily be extracted from the die unit 110 downwards in spite of the mounted holding-down device 140. This design is made possible only by the pressure plate 112 arranged below, because the hardened material of the pressure plate 112 allows the direct formation of four ground guide bores 150 which could not be accommodated in the die receptacle itself. The travel of the holding-down device 140 is limited by the height of the die-holding plate 116, minus the head height of the guide bolts 144.

Figure 10:
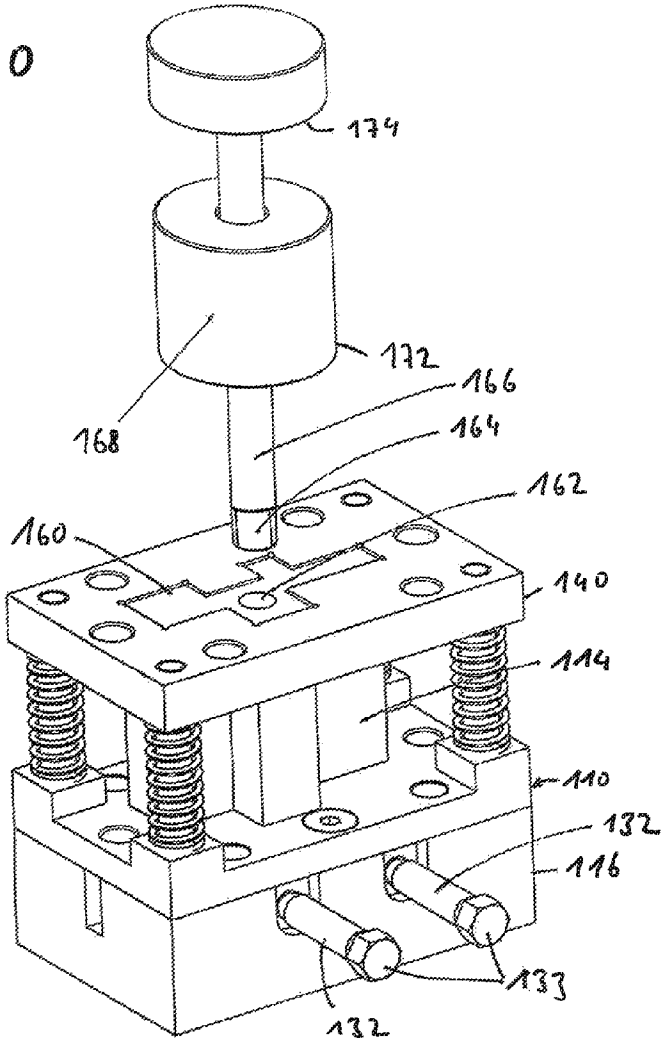
FIG. 10 shows an oblique view of a stamping die with a pull-out device for the die unit shown in FIG. 9.

FIG. 10 shows the die unit 110 shown in FIG. 9 from the side of the stamping-die 114. In this embodiment, the fastening bolts are replaced by corresponding fastening bolts 132 having hexagon heads 133 projecting laterally beyond the flank of the die-holding plate 116, so that the bolts are correspondingly accessible to an open-end spanner, even in narrow gaps between die units 110 lying next to one another.

What can also be seen clearly is an axial threaded bore 162 which lies approximately centrally in a stamping surface 160 of the stamping die 114 and into which can be screwed an external thread 164 on a shank 166 of a sliding hammer 168. The threaded bore 162 lies axially in alignment with the position of a fixing pin (not shown) of the die-holding plate 116, that is to say axially in alignment with a correspondingly formed fitting jaw 170 in the holding shoe 122 of the stamping die 114 (see also FIG. 11).

If the stamping die 114 cannot be removed after the release of the bolts 132, for example because it has become jammed with its holding shoe 122 under the action of the clamping forces, the threaded bore 162 enables the pull-out device designed as a sliding hammer 168 to be secured positively, striking pulses being capable of being introduced into the stamping die 114 with the aid of the movable hammer 172, which is movable up against a stop 174, so that the said stamping die 114 can come loose, this sometimes being necessary in order to demount the die unit 110 from the tool or else in order to regrind the stamping die 114 if it has become blunt.

Figure 11:
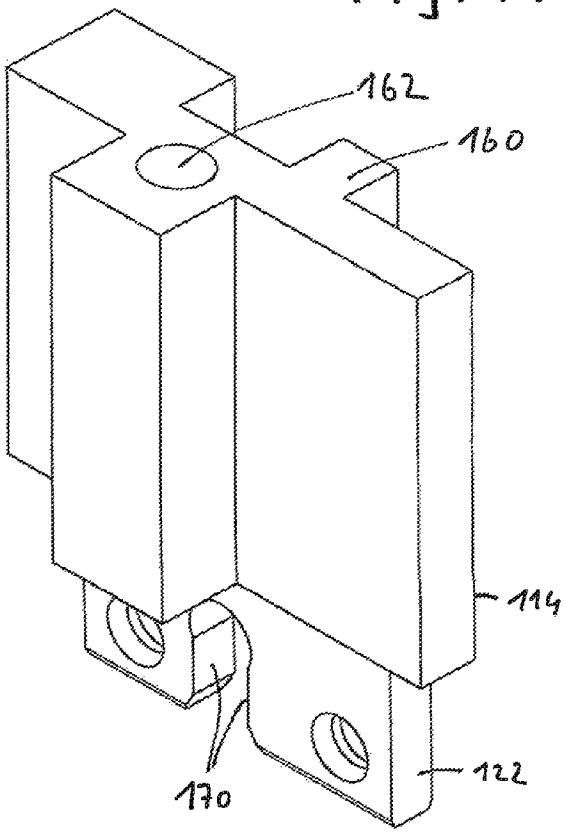
FIG. 11 shows an oblique view of the stamping die of the die unit shown in FIG. 1.

The solution shown in FIG. 10 and FIG. 11 can readily be employed in cases where the stamping die 114 has a sufficiently large stamping surface 160 to introduce a corresponding axial bore 162 for the internal thread without any material weakening significant for functioning capacity. In the case of stamping dies of very narrow build, what is provided as a further embodiment of an extension for applying a pull-out device is a transverse bore 362 (see FIG. 14) in a stamping die 314, the transverse bore 362 again lying in alignment with a fitting jaw 370 of the stamping die 314. It can be seen clearly from FIG. 12 and FIG. 13 that the very narrow stamping die 314 does not offer sufficient material to provide an internally threaded bore according to FIG. 10 and FIG. 11. The positive connection between the sliding hammer 168 and the transverse bore 362 takes place here by means of a U-shaped adapter 280, a screw connection 282 by means of aligned bores in the leg ends and the transverse bore 362 making the positive connection between the adapter 280 and the stamping die 314. The adapter 280 is provided at its other end with a threaded bush 284, into which the external thread 164 of the sliding hammer can be screwed, so that the pulses exerted upon the stop 174 by the movable hammer 172 can be introduced into the stamping die 314 in order to release it.

Figures 12, 13, 14:
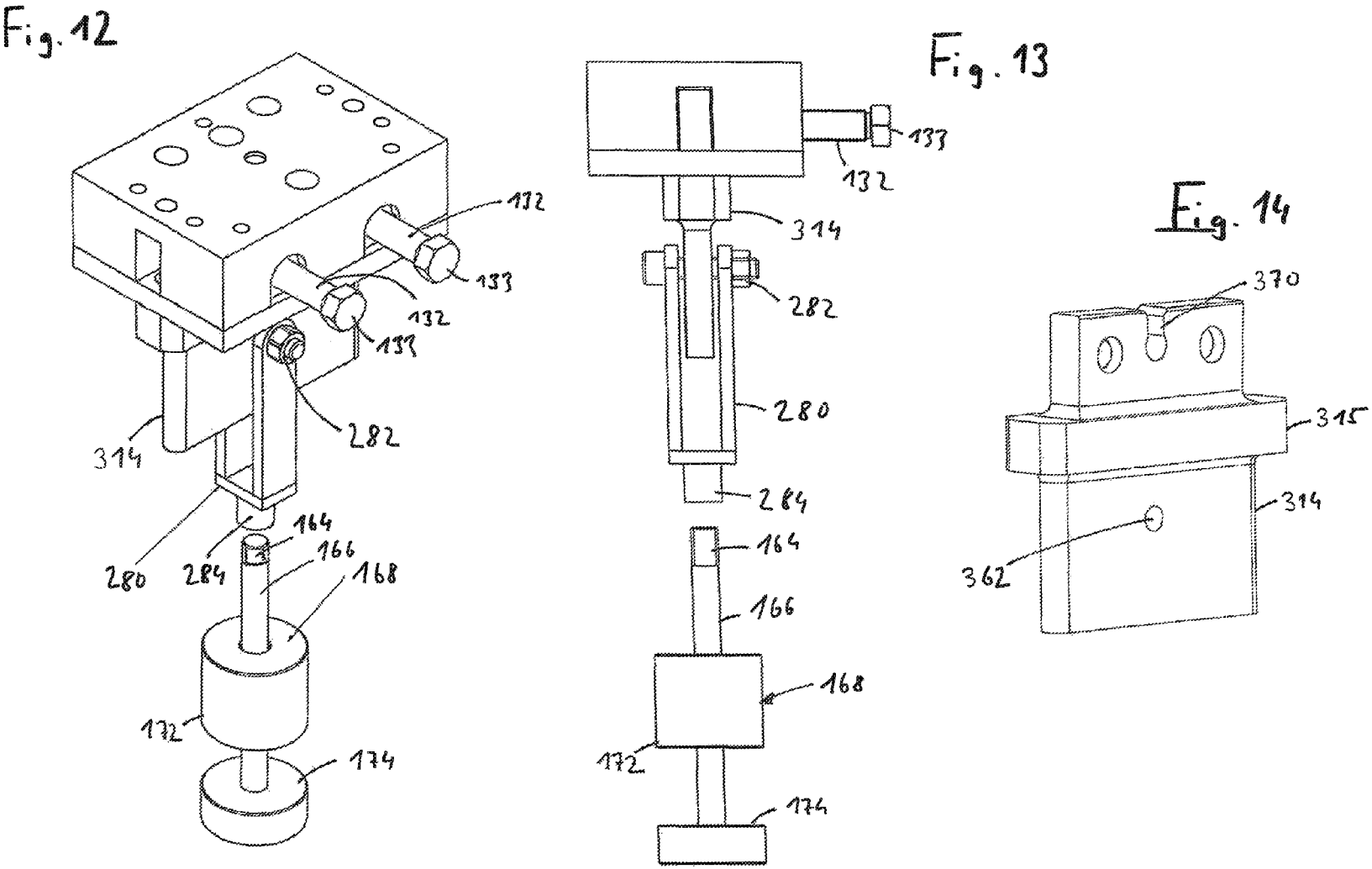
FIG. 12 shows an oblique view of a further embodiment of a die unit with a correspondingly adapted pull-out device.
FIG. 13 shows a side view of the die unit and of the pull-out device shown in FIG. 12.
FIG. 14 shows a perspective side view of the stamping die of the die unit shown in FIG. 12 and FIG. 13.

The form of construction of the stamping die 314 shown in FIG. 14 is designed with a band 315, since, because of the very slender form of the stamping die 314, a sufficient shoulder surface would not be available without the band. In such a case, the stamping die 314, to produce it, will then be hard-milled or machined by electric discharge, but a stripper plate similar to FIG. 9, integrated into the die unit, is not possible in this form.

Figure 15:
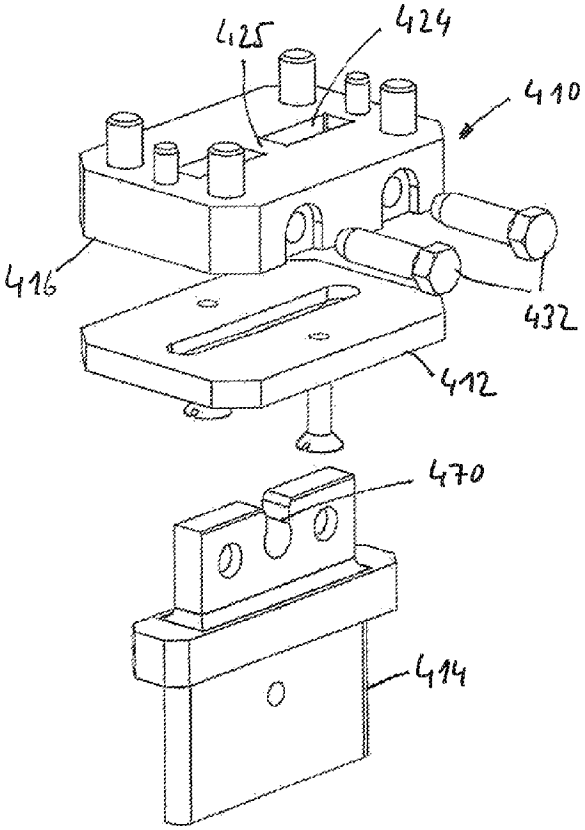
FIG. 15 shows an exploded diagram of a further embodiment of a die unit.

FIG. 15 shows a die unit 410 having a die-holding plate 416, a pressure plate 412 and a stamping die 414. Said stamping die unit largely corresponds to the stamping die units already presented above, such that a detailed description of most of the individual parts will be omitted here. By contrast to the embodiments described above, however, the slot 424 in the die-holding plate 416 is formed with a transverse web 425, which increases the stiffness of the die-holding plate 416 in said region. In the assembled state, the transverse web 425 engages into the fitting jaw 470, which is provided in any case, of the stamping die 414. It has been found that, by means of the transverse web 425, changes in dimension during the course of operation, such as can be caused for example by the tightening of the fastening screws 432 and the forces thus introduced into the die-holding plate 416, can be reduced.

Figure 16:
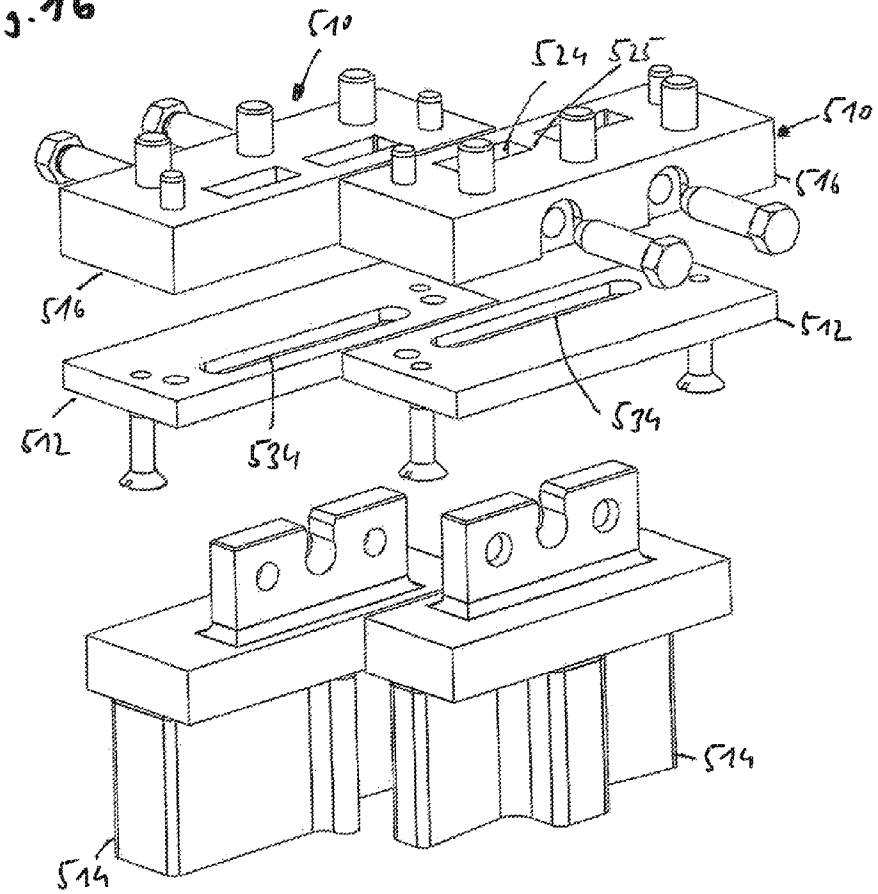
FIG. 16 shows an exploded diagram of die units according to a further embodiment of the present invention.

FIG. 16 shows a further embodiment of a die unit 510, in which a slot 524, which is likewise provided with a transverse web 525, in the die-holding plate 516 is, in the same way as an aligned slot 534 in the pressure plate 512, arranged offset eccentrically with respect to an edge. To illustrate the purpose of this measure, FIG. 16 shows a further die unit 510, which is arranged back-to-back with the second die unit 510. In this way, it is consequently possible for the stamping dies 514 of the die units 510 to be moved closer together and correspondingly accommodated in space-saving fashion in the tool. The remaining details of the die units 510 need not be discussed in any more detail at this juncture; these emerge to a person skilled in the art from the description of the preceding embodiments and from the accompanying drawing figures.

Figure 17:
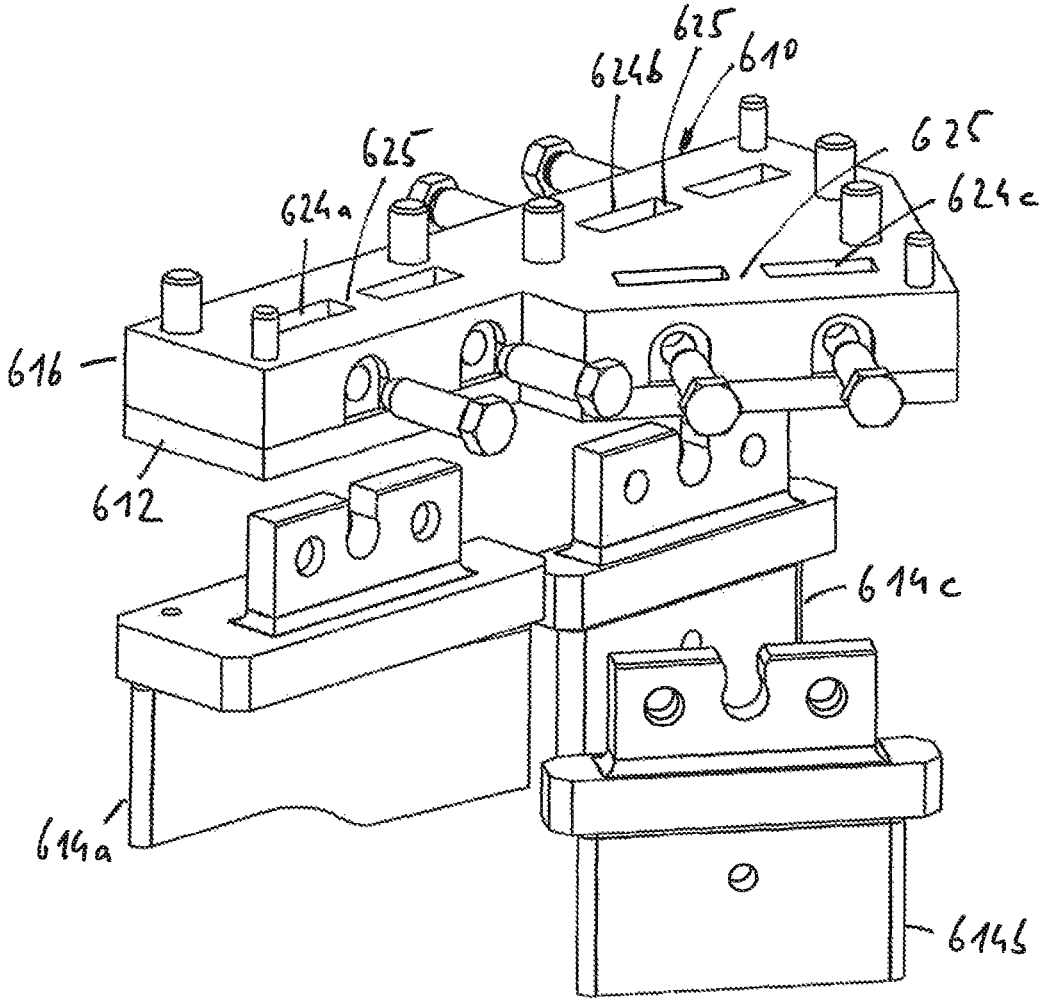
FIG. 17 shows an exploded diagram of a die unit having multiple stamping dies according to a further embodiment of the present invention.

Finally, FIG. 17 shows a die unit 610 which, as a special feature, has a die-holding plate 616 which has receptacles for three stamping dies 614*a*, 614*b* and 614*c*. For this purpose, three slots 624*a*, 624*b* and 624*c* are provided, which in turn are separated in each case by a transverse web 625. Aligned slots in the pressure plate 612, which is likewise of unipartite form, are not visible because the die-holding plate 616 and the pressure plate 612 are mounted on one another. Such an embodiment makes it possible for three stamping dies 614*a*, 614*b*, 614*c* to be accommodated, in a desired cross-sectional form and in a desired orientation with respect to one another, close together in a highly space-saving arrangement in the tool. Further combinations, for example with two, four, or even more stamping dies, are self-evidently readily possible.

That which is claimed is:

1. A die unit for fastening to an upper part of a stamping tool, the die unit comprising:

a pressure plate;

a stamping die having a shoulder; and a die-holding plate;

wherein the pressure plate is arranged between the stamping die and the die-holding plate; and wherein, during a stamping stroke, said pressure plate acts upon the shoulder of the stamping die; and wherein there is provided on the shoulder of the stamping die a holding shoe which projects through a slot in the pressure plate and which is fastened in the die-holding plate.

2. The die unit according to claim 1, wherein a right angle is provided between the holding shoe and the shoulder of the stamping die.

3. The die unit according to claim 1, wherein the die-holding plate has a releasable first fastening element which cooperates with a corresponding second fastening element on the holding shoe.

4. A die unit for fastening to an upper part of a stamping tool, the die unit comprising:

a pressure plate;

a stamping die having a shoulder; and a die-holding plate;

wherein the pressure plate is arranged between the stamping die and the die-holding plate;

wherein, during a stamping stroke, said pressure plate acts upon the shoulder of the stamping die;

wherein there is provided on the shoulder of the stamping die a holding shoe which projects through a slot in the pressure plate and which is fastened in the die-holding plate; and wherein at least one bore, into which a bolt engages, is provided in the holding shoe.

5. The die unit according to claim 4, wherein the bolt has a threaded region which engages into a threaded bore in the die-holding plate.

6. The die unit according to claim 5, wherein the head of the bolt and the bore are formed conically, so that the bolt, when being screwed in, draws the shoulder of the stamping die up against the pressure plate.

7. The die unit according to claim 1, wherein one or more fastening elements for connection to the upper part of the stamping tool are provided on the die-holding plate.

8. The die unit according to claim 1, wherein a holding-down device is provided, which is guided resiliently on the pressure plate by means of one or more guide bolts.

9. The die unit according to claim 1, wherein the stamping die has an extension for a pull-out device for pulling out in a stamping direction.

10. The die unit according to claim 9, wherein the extension has at least one bore lying transversely to the stamping direction.

11. The die unit according to claim 9, wherein the extension has a threaded bore which is provided in a stamping surface and which is oriented parallel to the stamping direction.

12. The die unit according to claim 11, wherein the threaded bore is arranged axially in alignment with a fixing means of the holding shoe.

13. The die unit according to claim 1, wherein a transverse web is provided in a slot in the die-holding plate.

14. The die unit according to claim 13, wherein the slot in the die-holding plate and the slot in the pressure plate are arranged eccentrically offset in an aligned manner.

15. The die unit according to claim 1, comprising a single die-holding plate and/or a single pressure plate having receptacles for a multiplicity of stamping dies.

16. A pull-out device for dismounting a stamping die of a die unit according to claim 9, wherein a sliding hammer is connected in positive locking fashion to the extension on the stamping die by way of a corresponding adapter element.

17. A system for the set-up of die units according to claim 1, comprising a specific number of the die-holding plates and the pressure plates in specific sizes, in each case with a specific slot in the die-holding plate and with a slot in the pressure plate, for the selective reception of a holding shoe of a multiplicity of stamping dies having different forming cross sections.

* * * * *